US005823684A

United States Patent [19]

Valeri

[11] Patent Number: 5,823,684

[45] Date of Patent: Oct. 20, 1998

[54] PROTECTIVE BELT FOR A DRUM FORMED BY A TRANSPORT BAG FOR POWDERY MATERIALS

[75] Inventor: Francis Valeri, Valence, France

[73] Assignee: Europeenne de Retraitement de Catalyseurs Eurecat, France

[21] Appl. No.: 935,340

[22] Filed: Oct. 2, 1997

Related U.S. Application Data

[63] Continuation-in-part of Ser. No. 684,393, Jul. 19, 1996, abandoned.

[30] Foreign Application Priority Data

Jul. 21, 1995 [FR] France ..... 95 08986

[51] Int. Cl.[6] ..... B65D 33/02

[52] U.S. Cl. ..... 383/119; 383/104; 383/105; 150/154

[58] Field of Search ..... 383/24, 32, 67, 383/104, 105, 75, 41, 111, 119, 903; 150/154; 206/597

[56] References Cited

U.S. PATENT DOCUMENTS

| | | | |
|---|---|---|---|
| 1,479,151 | 1/1924 | Moone | 150/154 |
| 2,035,384 | 3/1936 | Hinchliff | 150/154 X |
| 2,437,184 | 3/1948 | Brady et al. . | |
| 2,787,372 | 4/1957 | Sheard | 206/597 X |
| 2,977,148 | 3/1961 | Ford | 206/597 X |
| 3,331,501 | 7/1967 | Stewart, Jr. | 383/119 X |
| 3,374,929 | 3/1968 | Silfverskiöld | 383/119 X |
| 3,480,059 | 11/1969 | Schoening | 383/119 X |
| 3,491,847 | 1/1970 | Abbott | 150/154 X |
| 3,789,897 | 2/1974 | Saito | 383/67 X |
| 3,896,991 | 7/1975 | Kozlowski et al. | 383/119 X |
| 4,113,146 | 9/1978 | Williamson | 383/67 X |
| 4,628,535 | 12/1986 | Tetenborg | 383/24 |
| 4,781,475 | 11/1988 | LaFleur . | |
| 4,868,955 | 9/1989 | Magnant et al. | 206/597 X |
| 4,876,841 | 10/1989 | Jensen | 206/597 X |
| 4,909,410 | 3/1990 | Derby et al. | 383/119 X |
| 5,025,925 | 6/1991 | Wiklund | 206/597 X |
| 5,226,544 | 7/1993 | Gallucci et al. | 150/154 X |
| 5,439,727 | 8/1995 | Riggs et al. | 150/154 X |

FOREIGN PATENT DOCUMENTS

| | | | |
|---|---|---|---|
| 1 501 667 | 11/1966 | France . | |
| 2 267 256 | 11/1975 | France . | |
| 2672873 | 8/1992 | France | 383/119 |
| 953 235 | 7/1949 | Germany . | |

*Primary Examiner*—Jes F. Pascua
*Attorney, Agent, or Firm*—Millen, White, Zelano & Branigan, P.C.

[57] ABSTRACT

The present invention relates to belts used to protect drums formed by bags intended for transport of powders, granules or other powdery materials from tearing. The invention relates in particular to a belt designed to protect the drum formed by a bag intended for transporting materials placed in the body of said bag, to prevent it from tearing as a result of an external force, and being characterised in that it is cylindrical in shape, at least the top edge of its top and bottom edges being provided with an elastic band.

5 Claims, 2 Drawing Sheets

PROTECTIVE BELT FOR A DRUM FORMED BY A TRANSPORT BAG FOR POWDERY MATERIALS

This application is a continuation-in-part of application Ser. No. 08/684,393, filed Jul. 19, 1996, now abandoned.

FIELD OF THE INVENTION

The present invention relates to belts used to protect drums formed by bags intended for the transport of powders, granules or other powdery bulk materials from tearing.

The invention relates in particular to a belt designed to protect the drum formed by a bag intended for transporting materials placed in the body of said bag, to prevent it from tearing as a result of an external force, and being characterised in that it is cylindrical in shape, at least the top edge of its top and bottom edges being provided with an elastic retaining band.

STATE OF THE ART

Different transport bags are currently used to transport agricultural product, industrial materials and other powder or grain materials (the "materials to be transported") of a similar nature.

Such a transport bag is used by binding an opening made in its upper pail using a closure cord, closing a bottom closure, by opening an opening made in its upper part, placing the material to be transported in its body using this opening, by binding the upper opening using a closure cord and by closing an upper closure. The bag is then hoisted, for example, by a crane, placed on a specialised palette as illustrated in diagram 2, then lifted and transported by a fork-lift truck to a pre-determined place.

PROBLEM TO BE SOLVED BY THE PRESENT INVENTION

Nevertheless it may happen that the extremity in front of the fork of a truck of this type or one of the comers of the palette strikes the lower part of the bag during the transportation described above, or that an overhanging part of a building comes into contact with the periphery of the body of the bag when it is hoisted by the crane.

If such a situation occurs, the body of a traditional transport bag will be at risk of tearing, thus allowing the material transported to scatter.

Although it is possible in theory to increase the thickness of the walls of such a bag, and consequently to improve the resistance of the body of the bag to tearing, problems are nonetheless encountered in practice. For example, such a transport bag not only becomes expensive to produce but also heavier and more difficult to handle.

The invention concerned has been conceived with the aim of providing a solution to the situation described hereinabove, by providing a belt intended to protect the drum made from a transport bag, such a belt being able to prevent tearing of the body of the bag as a result of an external force, and being able to be produced in an economic manner without involving a substantial increase in the weight of the bag.

SUMMARY OF THE INVENTION

In order to achieve the object described above, the present invention provides, in a first embodiment, a belt designed to protect the drum made from a bag intended for transporting materials placed in its body, said protective belt fitting the body of the bag to prevent it tearing as a result of an external force, and being characterised in that it is cylindrical in shape, at least the top edge of its top and bottom edges being provided with an elastic retaining band.

Similarly, still with a view to achieving the object described above, a second embodiment of the present invention incorporates the first embodiment, which is then characterised in that the elastic band is sewn along the edge or edges of the belt.

Similarly, still with a view to achieving the object described above, a third embodiment of the present invention incorporates the first embodiment, which is then characterised in that the elastic band is housed in a passage formed at the level of the edge or edges of the belt.

Still in order to achieve the object described above, a fourth embodiment of the present invention takes the form of a belt intended to protect the drum made from a bag intended for transporting materials placed in the body of said bar, said protective belt attaching around said body of the bag to prevent it from tearing as a result of an external force and being characterised in that it is cylindrical in shape, and at least the top edge of the top and bottom edges are provided with a tie cord.

Similarly, still with a view to achieving the object described above, a fifth embodiment of the present invention incorporates the fourth embodiment, which is then characterised in that the cord is sewn along the edge or the edges of the belt.

Similarly, still with a view to achieving the object described above, a sixth embodiment of the present invention incorporates the fourth embodiment, which is then characterised in that the cord is housed in a passage formed at the level of the edge or edges of the belt.

Still in order to achieve the object described above, a seventh embodiment of the present invention is a belt intended to protect the drum made from a bag intended for transporting materials placed in the body of said bag, said protective belt attaching around said body of the bag to prevent it from tearing as a result of an external force and being characterised in that it has the shape of a band, the longitudinal extremities of which are provided with VELCRO hook and loop pads (or a similar device) which will be joined one to the other once the belt is positioned around the body of the bag.

Still in order to achieve the object described above, an eighth embodiment of the present invention is a belt intended to protect the drum made from a bag intended for transporting materials placed in the body of said bag, said protective belt attaching around said body of the bag to prevent it from tearing as a result of an external force and being characterised in that it has the shape of a band, the longitudinal extremities of which are provided with VELCRO hook and loop pads or the like which will face one another and will be united by their respective VELCRO hook and loop pads (or the like) situated on the periphery of the body of the bag.

Still in order to achieve the object described above, a ninth embodiment of the present invention is a belt intended to protect the drum made from a bag intended for transporting materials placed in the body of said bag, said protective belt attaching around said body of the bag to prevent it from tearing as a result of an external force and being characterised in that it has the shape of a band, the longitudinal extremities of which are provided with a pin and a buckle which engage one with the other once the belt is positioned around the body of the bag.

Operating principle

Firstly, with respect to the first three embodiments of the model, the cylindrical protective belt, the top edge or both the top and bottom edges of which are provided with an elastic retaining band, is fitted around a transport bag intended for transporting materials placed in the body of said bag, and is held in place by virtue of the elastic band with a view to preventing the body of the bag from tearing as a result of an external force.

Then, with respect to the fourth, fifth and sixth embodiments of the invention, the cylindrical protective belt, the top edge or both the top and bottom edges of which are provided with a tie cord, is fitted around a transport bag intended for transporting materials placed in the body of said bag, and is held in place by virtue of the tie cord with a view to preventing the body of the bag from tearing as a result of an external force.

With respect to the seventh embodiment of the invention, the protective belt is fitted around a transport bag intended for transporting materials placed in the body of said bag to prevent the body of the bag from tearing as a result of an external force has the shape of a band, the longitudinal extremities of which are provided with Velcro pads which will be joined one to the other once the belt is positioned around the body of the bag.

With respect to the eighth embodiment of the invention, VELCRO hook and loop pads or the like are present on the periphery of the body of a bag intended for transporting materials placed in the body of said bag, the protective belt surrounding the bag itself being fitted with VELCRO hook and loop pads (or an equivalent device) facing or uniting with the VELCRO hook and loop pads on the sac (or an equivalent system) which will keep it in place on the body of said bag, thus preventing the body of the bag from tearing as a result of an external force.

Lastly, with respect to the ninth embodiment of the invention, the protective belt to be fitted around the body of a bag intended for transporting materials placed in the body of said bag takes the shape of a band, the longitudinal extremities of which are provided with a pin and a buckle which engage one with the other once the belt is positioned around the body of the bag thus preventing the body of the bag from tearing as a result of an external force.

EXAMPLES

BRIEF DESCRIPTION OF DIAGRAMS OR FIGS. 1 TO 5

Diagram 1 is a perspective view of the first example.

Diagram 2 illustrates the embodiment as it will be transported by a fork-lift truck.

Diagram 3 is a perspective view of the second example.

Diagram 4 is a perspective view of the third example.

Diagram 5 is a perspective view of the fourth example.

Description of the symbols used

1 body of the bag
2*a*,2*b* opening portion
3*a*,3*b* opening cord
10,10*a* protective belt or band
11*a*, 11*b* elastic retaining belt
11*c*, 11*d* cords or ties
12*a*, 12*b* opening
12*c*, 12*d* passage
20*a*,20*b*, VELCRO peripheral sleeves band
21*a* pin
21*b* buckle

DETAILED DESCRIPTION

Figure 1:
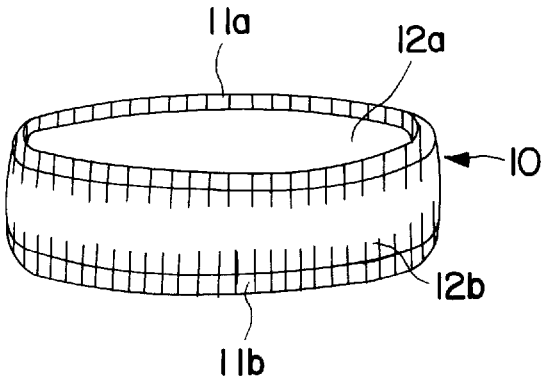
Figure 3:
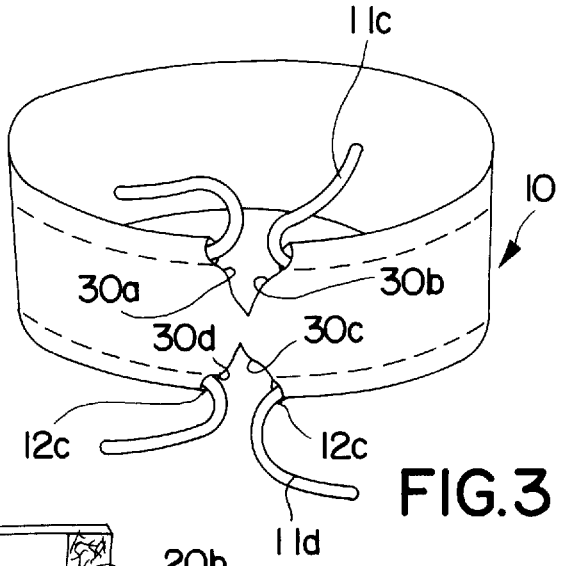
Figure 4:
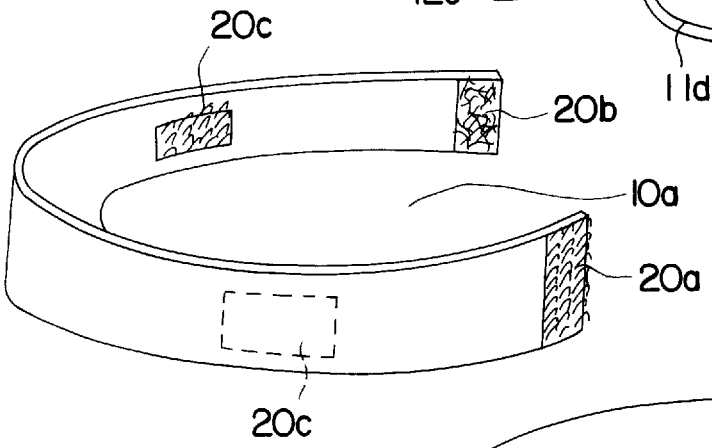
Figure 5:
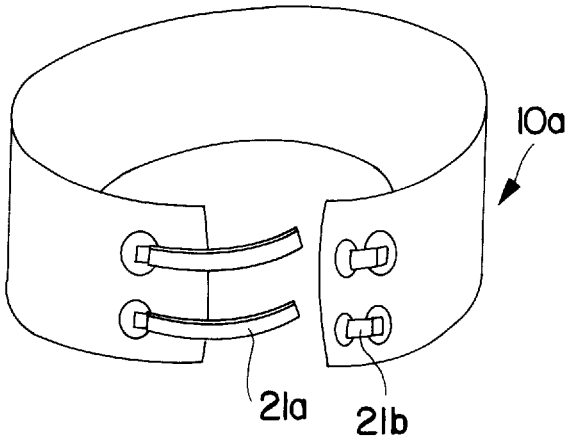
Figure 2:
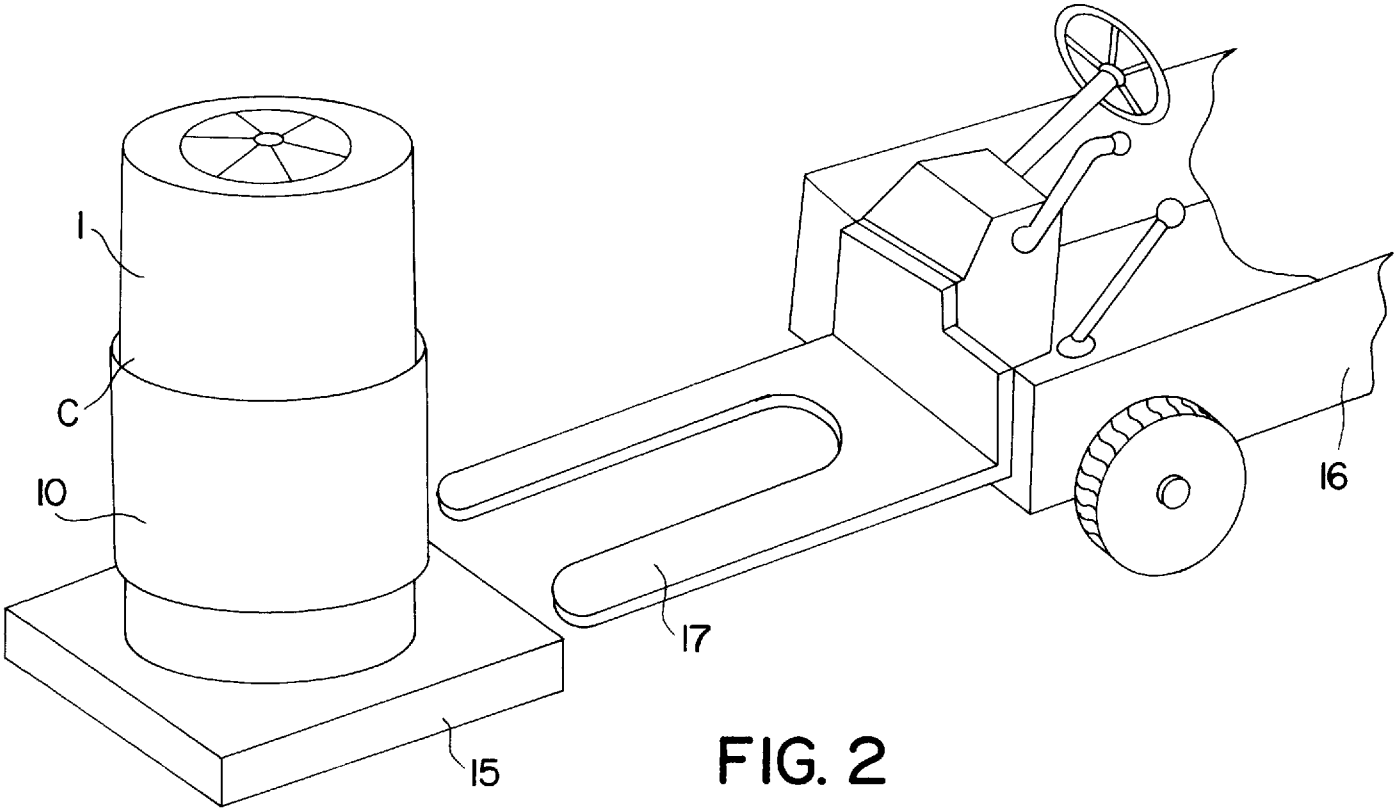

The description of the first embodiment of the present invention is made with reference to diagrams 1 and 2.

Diagram 1 is a perspective view of the present embodiment, while diagram 2 illustrates the present embodiment as it will be transported by a fork-lift truck.

According to this embodiment, a protective belt (10) of a relatively cylindrical shape, produced from synthetic resin, is provided with elastic retaining bands (11*a* and 11*b*) which are sewn along edges defining the top and bottom openings (12*a* and 12*b*) respectively, and is intended, as illustrated in diagram 1, to protect the body of a transport bag. Preferably, the protective belt 10 is of a substantially non-elastic material so that it does not radially expand when an outward radial force is applied by filling the bag.

The protective belt (10) thus composed is positioned around the transport bag to be used by inserting the bottom part of the bag into the opening (12*a*) or (12*b*) and will be retained in place on the body of the bag using elastic retaining bands (11*a* and 11*b*).

In this state, an opening made in the top part of the bag is open and an opening made in the bottom part of said bag is closed using a closure cord, complementary to the closure of traditional transport bags. The material to be transported is placed in the body (1) of the bag by means of the top opening, which has the effect of enlarging the body (1) of the bag axially and radially and of stretching the elastic retaining bands (11*a* and 11*b*) with a view to positioning the protective belt (10) in close contact with the periphery of the body (1) of the bag. The body of the bag rests on its bottom with the protective belt (10) around an intermediate portion between two bottom and top of the bag, the protective belt forming a cylindrical reinforcing band when the bag is filled with bulk material.

Diagram 2 illustrates the transport bag (C) placed on a palette (15). The body (1) of the bag is filled with the material to be transported and equipped with the protective belt (10), its top opening being bound and closed according to the traditional method. When the palette (15) transporting the bag (C) is lifted and moved, in the present case by the forks (17) of a fork-lift truck (16), it may happen that one of the corners of the palette (15) or the front extremity of the fork (17) strikes the transport bag (C) at the moment when the palette or the fork approaches said bag, in which case the belt (10) protects the body (1) of the bag from tearing, thus preventing the material transported from escaping from said bag. The belt (10) protects the body (1) of the transport bag (C) against the palette (15) or the fork (17) but also from possible contact of the bag with an overhanging part of a wall when, for example, the bag (C) is transported by a lifting truck.

As a result, the present embodiment can easily be fitted onto the transport bag (C) before use of said bag, being kept in place by the clamping applied by the elastic retaining bands (11*a* and 11*b*) and thus preventing the body (1) of the bag filled with the material to be transported from tearing as a result of an external force exerted, for example, by the fork (17) of the lifting truck (16) at the time when the bag (C) is transported.

Although according to the embodiment illustrated, the elastic retaining bands (11*a* and 11*b*) are sewn along the top and bottom edges of the protective belt (10), said belt could be provided with a single elastic retaining band fixed at the level of its top edge alone, when it is unlikely that the bottom part of the belt can be rolled up from the bottom.

Example 2

The description of the second embodiment of the present invention is made with reference to diagram 3.

Diagram 3 is a perspective view of the present embodiment.

According to this embodiment, the cords (11*c* and 11*d*) are housed in passages (12*c* and 12*d*) formed along the peripheral opening edges of a protective belt, as illustrated in diagram 3, in contrast to the first embodiment in which elastic retaining bands (11*a* and 11*b*) are sewn along the top and bottom edges of such a protective belt at relieved portions 30*a*, 30*b*, 30*c* and 30*d* thereof. Nevertheless, the field of application of the two first embodiments and the effect produced are similar. When the belt is used in a manner in which it cannot be rolled up from the bottom, a single cord could be used in the passage made in the top edge, as in the preceding embodiment.

Although according to the first embodiment described, the elastic retaining band is sewn onto the protective belt, said band could be housed in a passage formed along the peripheral opening edge as in the second embodiment. On the other hand, with this second embodiment, the cords could be sewn on the top and bottom edges respectively as in the first embodiment.

Example 3

The description of the third embodiment of the present invention is made with reference to diagram 4.

Diagram 4 is a perspective view of the present embodiment.

As indicated in diagram 4, the protective belt (10A) according to this embodiment takes the form of a band made from synthetic resin fibres, the respective longitudinal extremities of said belt are provided with VELCRO hook and loop pads (20*a* and 20*b*) which can be attached one to the other. Furthermore, still in accordance with the present embodiment, the band is also provided with VELCRO hook and loop pads (20*c*) situated locally on the surface of said band, which come into contact with the body (1) of the bag, said VELCRO hook and loop pads facing corresponding VELCRO pads situated on the periphery of the body (1) of the bag, to which they will be attached.

The protective belt (10A) thus constituted according to the present embodiment surrounds the transport bag to be used and is kept in place by joining the VELCRO pads (20*c*) to the corresponding VELCRO hook and loop pads on the bag and by fixing the terminal VELCRO pads hook and loop (20*a* and 20*b*) to one another.

In this state, an opening made in the top part of the bag is open and an opening made in the bottom part of said bag is closed using a closure cord, in addition to the closure used for traditional transport bags. The material to be transported is then placed in the body (1) of the bag by means of the top opening, which has the effect of enlarging the body (1) of the bag axially and radially and allowing the protective belt (10A) to cover practically the whole circumference of the body (1) of the bag and to be kept in place on said bag by the VELCRO hook and loop pads (20*a* and 20*b*) joined to one another.

As described previously within the framework of the first embodiment, the protective belt (10*a*) used in this way prevents the body (1) of the bag from tearing as a result of an external force.

As a result, according to the third embodiment, the protective belt (10A) can easily be fitted around the body (1) of the transport bag, and attached to said bag with the aid of VELCRO hook and loop pads (20*a*, 20*b*, and 20*c*) with a view to preventing the body (1) of the bag filled with the material to be transported from tearing as a result of an external force exerted, for example, by the fork (17) of the lifting truck (16) when the bag (C) is transported.

Example 4

The description of the fourth embodiment of the present invention is made with reference to diagram 5.

Diagram 5 is a perspective view of the present embodiment.

In contrast with the third embodiment, in which the protective belt has the form of a band made of synthetic resin fibres, the longitudinal extremities of which band are joined by means of VELCRO hook and loop pads (20*a*) and (20*b*), the protective belt (10A) according to the present embodiment takes the shape of a band, one of the longitudinal extremities of which is with provided with pins (21*a*) and the other longitudinal of which is provided with buckles (21*b*) as illustrated in diagram 5. The belt can easily be fitted around the body (1) of a transport bag by engaging the pins (21*a*) in the buckles (21*b*) to prevent the body (1) of the bag filled with the material to be transported from tearing as a result of an external force exerted, for example, by the fork (17) of the lifting truck (16) when the transport bag (C) is transported.

Advantages of the devices according to the invention

The patent application provides a belt intended to protect the drum made from a bag intended for transporting materials placed in the body thereof, being a belt of a cylindrical shape with can easily be fitted around the periphery of the body of the bag and fixed thereon by means of elastic retaining bands or cords provided at the level of the top and bottom edges of said belt, such a belt thus being easy to fit, inexpensive to produce and intended to prevent the body of the bag from tearing as a result of an external force excited dulling transport and without involving a substantial increase in the weight of the bag.

The devices according to the invention also provide a belt intended to protect the drum made of a bag intended for transporting materials placed in the body of the bag and being easily fixed to said bag by joining together VELCRO hook and loop pads or by engaging pins in buckles, such a belt thus being easy to fit, inexpensive to produce and intended to prevent the body of the bag from tearing as a result of an external force exerted during transport and without involving a substantial increase in the weight of the bag.

I claim:

1. In combination with a flexible transport bag of a circular cross-section and having a bottom portion, a top portion and an intermediate portion therebetween, wherein when the bag is filled with a bulk material, the bag is stiffened and, wherein the bag when filled rests on the bottom end thereof, a reinforcing band comprised of a non-elastic web and having first and second relieved portions; at least one first flexible tie at the first relieved portion of the band and at least one second flexible tie at the second relieved portion of the band, the first and second ties being tied to one another to fix the diameter of the reinforcing band when fitted around the bag, the reinforcing band being placed around the intermediate portion of the bag with the bottom and top portion of the bag being exposed to provide a substantially cylindrical, stiff reinforcing band when the bag is filled with the bulk material.

2. The combination of claim 1, wherein the flexible ties are retained on the band in peripheral sleeves extending along upper and lower edges of the band.

3. In combination with a flexible transport bag of a circular cross-section and having a bottom portion, a top portion and an intermediate portion therebetween, wherein when the bag is filled with a bulk material, the bag is stiffened and, wherein the bag when filled rests on the bottom end thereof, a reinforcing band comprised of a non-elastic web and having first and second end portions; at least one first hook and loop fastener at the first end portion and at least one second hook and loop fastener at the second end portion, the first and second fasteners being coupled to one another to fix the diameter of the reinforcing band when fitted around the bag, the reinforcing band being placed around the intermediate portion of the bag with the bottom and top portion of the bag being exposed to provide a substantially cylindrical, stiff reinforcing band when the bag is filled with the bulk material.

4. The combination of claim 3, wherein the hook and loop fasteners are patches on inner and outer surfaces of the band with patches on the inner surface being adjacent one end portion of the band and patches on the outer surface being adjacent the other end portion of the band.

5. In combination with a flexible transport bag of a circular cross-section and having a bottom portion, a top portion and an intermediate portion therebetween, wherein when the bag is filled with a bulk material, the bag is stiffened and, wherein the bag when filled rests on the bottom end thereof, a reinforcing band comprised of a non-elastic web and having first and second end portions; at least one pin at the first end portion and at least one buckle fastener at the second end portion, the first and second fasteners being coupled to one another to fix the diameter of the reinforcing band when fitted around the bag, the reinforcing band being placed around the intermediate portion of the bag with the bottom and top portion of the bag being exposed to provide a substantially cylindrical, stiff reinforcing band when the bag is filled with the bulk material.

* * * * *